US005784803A

United States Patent [19]

Toyoda et al.

[11] Patent Number: 5,784,803

[45] Date of Patent: Jul. 28, 1998

[54] OIL REMOVING METHOD FOR A PIPE COIL

[75] Inventors: Katsumasa Toyoda, Ohgaki; Takashi Miyajima, Gifu-ken; Yoshihiro Umeda, Nagoya, all of Japan

[73] Assignee: Daidotokushuko Kabushikikaisha, Japan

[21] Appl. No.: 755,500

[22] Filed: Nov. 22, 1996

Related U.S. Application Data

[62] Division of Ser. No. 228,523, Apr. 15, 1994, Pat. No. 5,603,167.

[30] Foreign Application Priority Data

Nov. 11, 1993 [JP] Japan ..... 5-307478
Nov. 25, 1993 [JP] Japan ..... 5-321268

[51] Int. Cl.[6] ..... F26B 7/00

[52] U.S. Cl. ..... 34/437; 34/104; 15/104.03; 15/304; 219/634

[58] Field of Search ..... 34/104, 437; 15/104.03, 15/304

[56] References Cited

U.S. PATENT DOCUMENTS 4,543,057 9/1985 Nakamura et al. ..... 431/208
4,627,814 12/1986 Hattori et al. ..... 432/128
5,468,937 11/1995 Yokogi ..... 219/634

FOREIGN PATENT DOCUMENTS 557263A 3/1993 Japan .
6170348 6/1994 Japan ..... 15/104.03

*Primary Examiner*—Henry A. Bennett
*Assistant Examiner*—Pamela A. O'Connor
*Attorney, Agent, or Firm*—William A. Drucker

[57] ABSTRACT

A pipe coil is heated in the furnace of a heat treatment apparatus. The oil adhered to the inside of the pipe is vaporized by this heating. In this state the oil removing gas is fed at one end into the pipe which gas is in the high temperature enough to maintain the vaporizing condition of the oil. The vaporized oil within the pipe is discharged by the feeding of the gas at the other end of the pipe while the oil is in the vaporized state.

2 Claims, 4 Drawing Sheets

OIL REMOVING METHOD FOR A PIPE COIL

This is a divisional of application Ser. No. 08/228,523 filed on Apr. 15, 1994 now U.S. Pat. No. 5,603,167.

BACKGROUND OF THE INVENTION

1. Field of the Invention

The present invention relates to an apparatus for applying heat to a pipe coil. More particularly, it relates to an oil removing apparatus and to the oil removing method for removing the oil adhered to the inside of a pipe wound in a coil by heating the pipe.

2. Description of the Prior Art

During the manufacturing process of a pipe coil formed by coiling a long size metal pipe of fine diameter, a kind of oil, for example rolling oil, adheres over the inner and outer walls of the pipe. When such pipe coil is treated by, for instance, bright annealing in a heat treatment apparatus, the oil over the outer surface can be vaporized and removed by heating. But the oil inside the pipe is not discharged and remains. Accordingly, work has been carried out to remove the above-mentioned oil prior to the heat treatment of the pipe coil. For instance, the gas for removing the oil is fed into the pipe at one end of the pipe coil. The feeding of the gas vaporizes the oil inside the pipe and the vaporized oil is discharged from the other end of the pipe together with the gas.

In some cases, however, the pipe coil is exceedingly long, for instance, a number of ten thousands of meters. Accordingly there is a problem that it takes a very long time to vaporize the oil in the whole area of the inside of the pipe and to discharge it. Also if the removing work is ended in to short a time, some of the oil remains inside the pipe. The remaining oil produces another problem that when the user of the pipe as a product pours contents, for instance, refrigerant for an air conditioner, into the pipe, the oil contaminates the content.

SUMMARY OF THE INVENTION

It is an object of the present invention to provide an oil removing apparatus for a pipe coil which can substantially completely purge, in, the oil adhered to the inside of the pipe by heating the pipe coil, and moreover which can carry out the oil removal in a short time by the use of the heated gas as the purge gas.

It is another object of the present invention to provide an oil removing apparatus for a pipe coil which can heat a pipe coil exceedingly fast and efficiently by initially heating the purge gas to be injected into the coil for heating the pipe coil.

It is a further object of the present invention to provide an oil removing apparatus for a pipe coil which can initially heat the purge gas in a short time and with high thermal efficiency by utilizing the thermal energy to heat the pipe coil within a furnace which has exceedingly large thermal energy capacity.

It is a further object of the present invention to provide an oil removing method wherein when the pipe coil has been sufficiently heated, the purge gas is blown into the pipe, the blown gas is heated by utilizing the thermal energy within the pipe, and the heated gas purges the vaporized oil within the pipe.

It is a further object of the present invention to provide a connecting device which can be employed to connect both ends of the pipe coil even under the bad condition of the inside of the furnace in high temperature.

It is a further object of the present invention to provide a connecting device which can be employed for feeding gas into the pipe at the entrance of a pipe coil disposed in a furnace and to provide a connecting device which can be employed not only for feeding the gas into the pipe at the entrance of the pipe coil but also for discharging the gas out of the furnace at the exit of the pipe coil.

It is a further object of the present invention to provide an oil removing apparatus which can purge the oil vapor out of the furnace without leaking inside the furnace when the oil vapor within a pipe coil is discharged for purging and, as a result, which can delay the progress of contamination of the atmosphere within the furnace with the oil vapor.

It is a further object of the present invention to provide a structure of connecting portions of pipes which structure can feed the gas to a member to receive the gas only by pressing both the members to each other and also which can prevent the communicated portion from leaking the gas outside.

It is a further object of the present invention to provide a structure of connecting portions of pipes which structure is adapted for easy mutual connection between a member to feed the gas and a member to receive the gas when the pipe coils are entered one after another into the furnace and even when positioned at slightly different locations.

DESCRIPTION OF A PREFERRED EMBODIMENT

Figure 1:
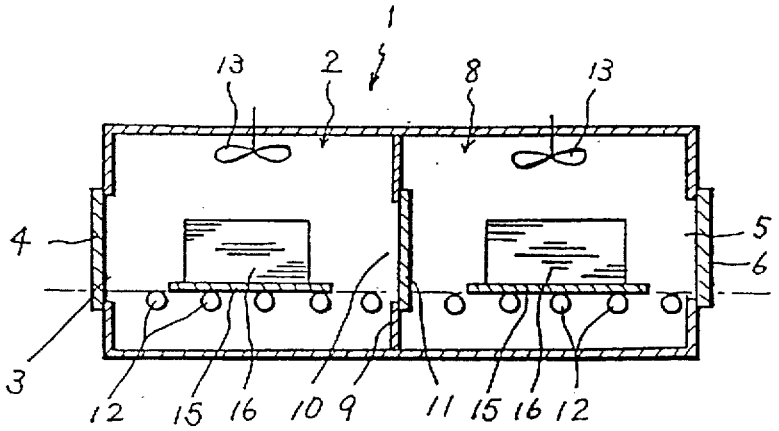
FIG. 1 (PRIOR ART)
FIG. 1 is a schematic sectional view of a continuous annealing furnace.

Referring to FIG. 1, the numeral 1 designates a heat treatment apparatus of a pipe coil 16, for example, a continuous annealing furnace, which has an entrance 3 at the one end and an exit 5 at the other end. The entrance 3 and exit 5 are provided with doors 4 and 6 which are opened respectively when a pipe coil is passed through. Numeral 2 designates a heating chamber (hereinafter the chamber is also called simply a furnace) and numeral 8 a cooling chamber, in the continuous annealing furnace. Each of the chambers has an accommodating space which can accommodate one pipe coil 15 at a time therein. A partition 9 is provided between both chambers to separate them. Numeral 10 designates a communicating port formed in the partition 9, which port is provided with a door 11 to be opened when the pipe coil is passed through. Numeral 12 designates rollers for transporting the pipe coil, which are arranged in the whole area of the heating and cooling chambers. Numeral 13 shows a well-known circulating fan for circulating the heat treatment gas. Incidentally, the furnace 2 is provided with a heat source, though it is not illustrated, for example, an electric heater or a radiant tube type burner. It is adapted to heat the atmospheric gas within the furnace 2 as the heat source for heating the pipe coil within the furnace 2. Also the cooling chamber 8 is provided with a cooling means for cooling the gas therein.

Figure 2:
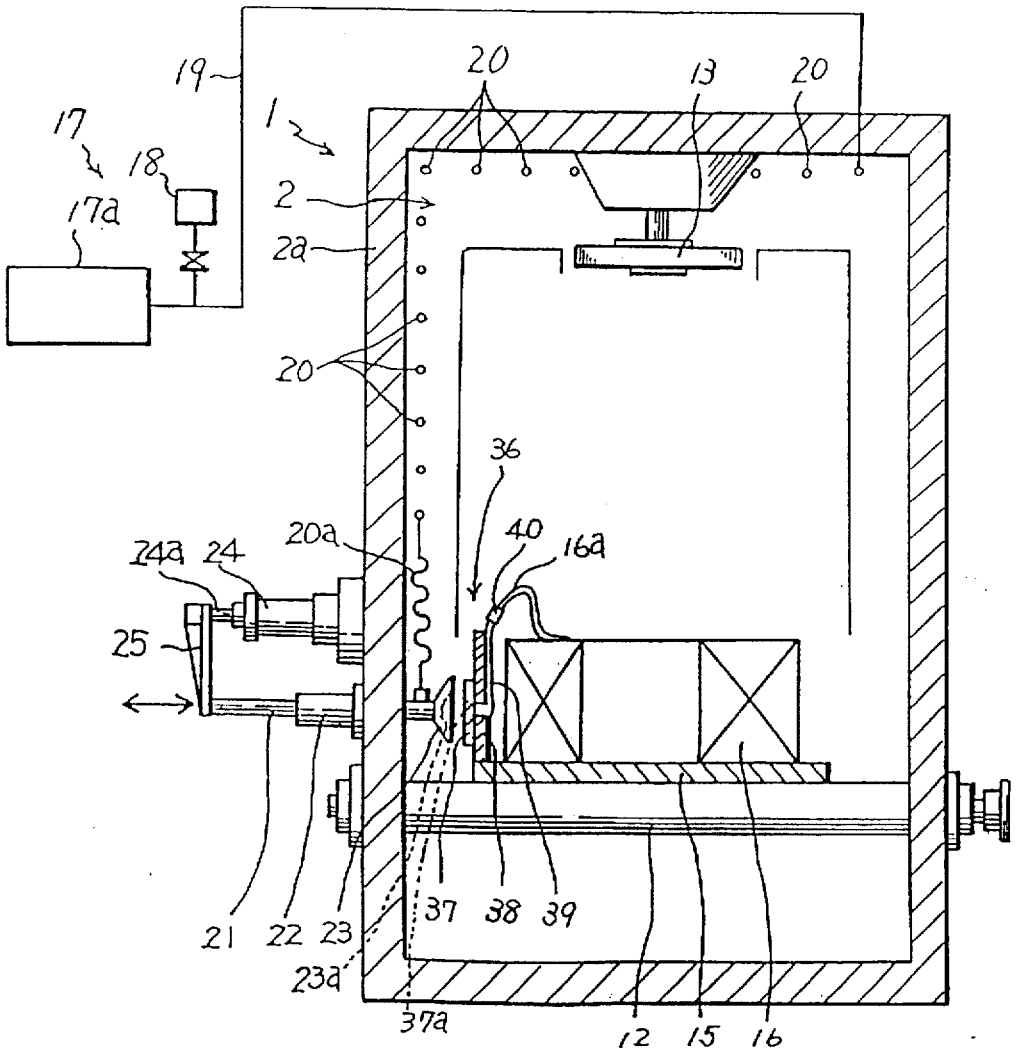
FIG. 2 (PRIOR ART)
FIG. 2 is a vertical sectional view of a heating chamber.

Referring to FIG. 2, there is shown a mechanism for removing oil provided in the furnace 2. Numeral 17 designates gas supply means. Numeral 17*a* designates a compressor in the gas supply means 17 for pressurizing the gas (the gas to be fed into the pipe coil) which is supplied from a gas supply source, for example, a gas generating apparatus. Numeral 18 is a pressure switch, which automatically controls the operation of a compressor 17*a* so as to supply the gas in a constant pressure.

A gas supply passage is described which introduces the above-mentioned gas into the furnace. Numeral 19 designates a pipe line for feeding the gas. Numeral 20 designates a gas supply passage disposed in the furnace 2. The gas supply passage 20 is composed of a metal pipe and disposed in zigzag along the inner surface of the furnace wall 2*a* of the furnace 2 so that the gas which runs therein is efficiently heated by heat from the heat source in the furnace 2. Numeral 20*a* is a flexible pipe line forming a part of the gas supply passage 20. Next, a connecting mechanism for connecting the gas supply passage 20 to the pipe coil 16 is described. Numeral 21 designates a push-pull rod, which is supported by a holder 22 secured to the furnace 2 for moving back and forth in the direction of the arrow. The push-pull rod 21 is hollow and connected to the flexible pipe line 20*a* to be communicated with the hollow portion. Numeral 23 designates a supply port member (also called a joint member) which is illustrated for instance, as communicating means connected to one end of the gas supply passage 20 and in the central portion of which is formed an opening 23*a* for feeding the gas. The opening 23*a* is communicated with the flexible pipe line 20*a* through the hollow portion of the push-pull rod 21. The supply port member 23 is made, for instance, from heat resistant steel. Numeral 24 designates a push-pull device for moving the push-pull rod 21 back and forth and, for instance, an air cylinder is employed as the device 24. The piston rod 24*a* of this air cylinder is connected to the push-pull rod 21 through a joint member 25.

Numeral 15 is a tray for carrying a pipe coil thereon and numeral 36 is communicating means, which communicates one end 16*a* of the pipe of the coil 16 on the tray 15 with the supply port member 23. Numeral 37 designates an intake port member of this communicating means, which member is installed on a support bracket 38 mounted on the tray 15. The height of the installation is set at the same level as that of the supply port member 23. The intake port member 37 is provided in the center portion with an opening 37*a* for communicating with the opening 23*a* of the supply port member 23. The intake port member 37 is made, for example, from heat resistant steel. Numeral 39 designates a pipe joint, one end of which communicates with the opening 37*a* of the intake port member 37. Numeral 40 designates a coupling provided on the other end of the pipe joint 39, which coupling removably connects one end 16*a* of the pipe of the coil 16 mounted on the tray 15.

Now the process to anneal the pipe coil 16 will be explained according to the annealing furnace 1 of the above described construction. The pipe coil 16, formed by winding a long size pipe, which is mounted on the tray 15, is first carried in the furnace 2 sliding on the rollers 12. The pipe of the pipe coil 16 has the inner diameter of, for instance, 6 to 15 mm and the thickness of, for instance, about 1 mm. The material of the pipe 16*a* is copper, aluminum or other material. The pipe coil 16 is stopped at the predetermined position when it has been carried into the furnace 2. When the pipe coil 16 is stopped, the supply port member 23 is advanced by operation of the push-pull device 24 to the intake port member 37 and connected under pressure to the intake port member 37. As a result, a communicating state is made between the hollow portion 23*a* of the supply port member 23 and the hollow portion 37*a* of the intake port member 37. In this state, the heat source and the circulating fan 13 are operated in the furnace 2, the atmospheric gas in the furnace 2 is heated. The pipe coil 16 is heated at its outer side by the heated atmospheric gas. The temperature of the heated atmospheric gas in the furnace 2 is, for instance, 450° C. for the aluminum pipe coil 16 and 600° C. for the copper one.

On the other hand, a gas for purging inside the pipe is supplied from the compressor 17*a*. For this purpose a gas that is free from the bad effect to the heated pipe is employed which is, for instance, air for the aluminum pipe or a non-oxidizing gas such as nitrogen for the copper or others. The supplied gas runs through the pipe line 19 to the gas supply passage 20. The gas is heated to the high temperature gas in the process of running through the gas supply passage 20, and the temperature is the same level as, for instance, that of the atmospheric gas in the furnace. This high temperature gas is fed through the supply port member 23 and intake port member 37 into the pipe of the pipe coil 16 at the end 16*a*. The pipe is heated also in the inner side by the fed gas.

Since the pipe is heated both in the outer side and in the inner side as described above, it is raised to the predetermined high temperature for annealing at high rate of temperature increase.

In the above-stated heating process, the oil, for instance the rolling oil, adhered within the pipe of the pipe coil 16 is vaporized to the gaseous state according to the rise of the temperature in the pipe coil 16. Incidentally, three kinds of the above-stated oil are used, the vaporizing temperatures of which are, for instance, 150° C., 200° C. and 300° C. respectively. The oil changed to the gaseous state is urged by the gas which is being fed into the pipe at the one end 16*a*, and discharged from the other end of the pipe into the inside of the furnace 2. For this case, the temperature of the fed gas is so high that the above oil is discharged as the state of gas is maintained. Thus the oil in the pipe is discharged and the cleaning in the pipe is exceedingly accomplished.

According to the continuation of the above-described heating for a predetermined time, the predetermined heating for the pipe coal 16 is completed. Then the compressor 17*a* is stopped, and the supply port member 23 is retracted. The pipe coil 16 in the furnace 2 is carried by the operation of the rollers 12 to the cooling chamber 8. In the cooling chamber 8 the pipe coil 16 is treated, as well known, in the preferred cooling step of the annealing process. When the cooling step is completed, the pipe coil 16 is sent out of the exit 5.

Next, another embodiment will be illustrated relating to the annealing furnace 1. Both the above-stated furnace 2 and cooling chamber 8 may be those having the length which can accommodate a plurality of the pipe coils in the longitudinal arrangement. Further the above-stated furnace 2 may comprise a plurality of spaces in the longitudinal arrangement so that the heating step may be divided into a plurality of steps, each of which may be performed in each of the divided spaces. Furthermore the cooling chamber 8 also may comprise a plurality of spaces in the longitudinal arrangement so that the cooling step may be divided into a plurality of steps, each of which may be performed in each of the divided spaces. Furthermore a well-known front chamber may be provided in front of the furnace 2 and a well-known rear chamber may be added in the rear of the cooling chamber 8. Moreover the annealing furnace 1 may not be the continuously treating furnace constituted as described above but may be a furnace constituted so that a batch system treatment may be performed. Such a batch system furnace may be provided with a mechanism for supplying the gas as shown in FIG. 2, and the gas may be supplied in the same process as described above. Furthermore the furnace 2 may be adapted so that the pipe coil 16 can be lifted by 10 to 20 mm together with the tray 15 by means of a lifter or the like. For this case, the hollow portion 23*a* of the supply port member 23 and the hollow portion 37*a* of the intake port member 37 may be in the communicated condition when the pipe coil 16 is lifted. As a result, it is possible to cause the rollers 12 to oscillate. The oscillation serves to prevent the roller from deforming when the inside of the furnace is at high temperature.

As described above, for the heat treatment of the pipe coil 16, the pipe of the pipe coil 16 can be heated not only in the outside by the heat from the above-stated heat source but also at the inner side by the preheated gas running inside the pipe. Consequently, the effect is enjoyed that the rate of raising the temperature of the pipe coil 16 may be improved and the heat treatment time may be shortened.

Furthermore, for the above-described heating, even when the oil is adhered within the pipe of the pipe coil 16, the oil may be vaporized as the temperature of the pipe is raised. The vaporized oil can be discharged from the inside of the pipe by the above-described heated gas purging through the inside of the pipe. The fact means that the cleaning of the inside of the pipe may be performed without any special process for the oil discharging. As a result, it is possibly efficient to provide products of good quality without any oil remaining inside the pipe.

Besides there is a further feature that any special heat source may not be required for heating the gas since the heating of the gas is performed by raising the temperature of the gas running through the gas supply passage 20 by the heat source for heating the pipe coil within the furnace 2 even when the several effects as described above are obtained by utilizing the above-described heated gas.

Figure 3:
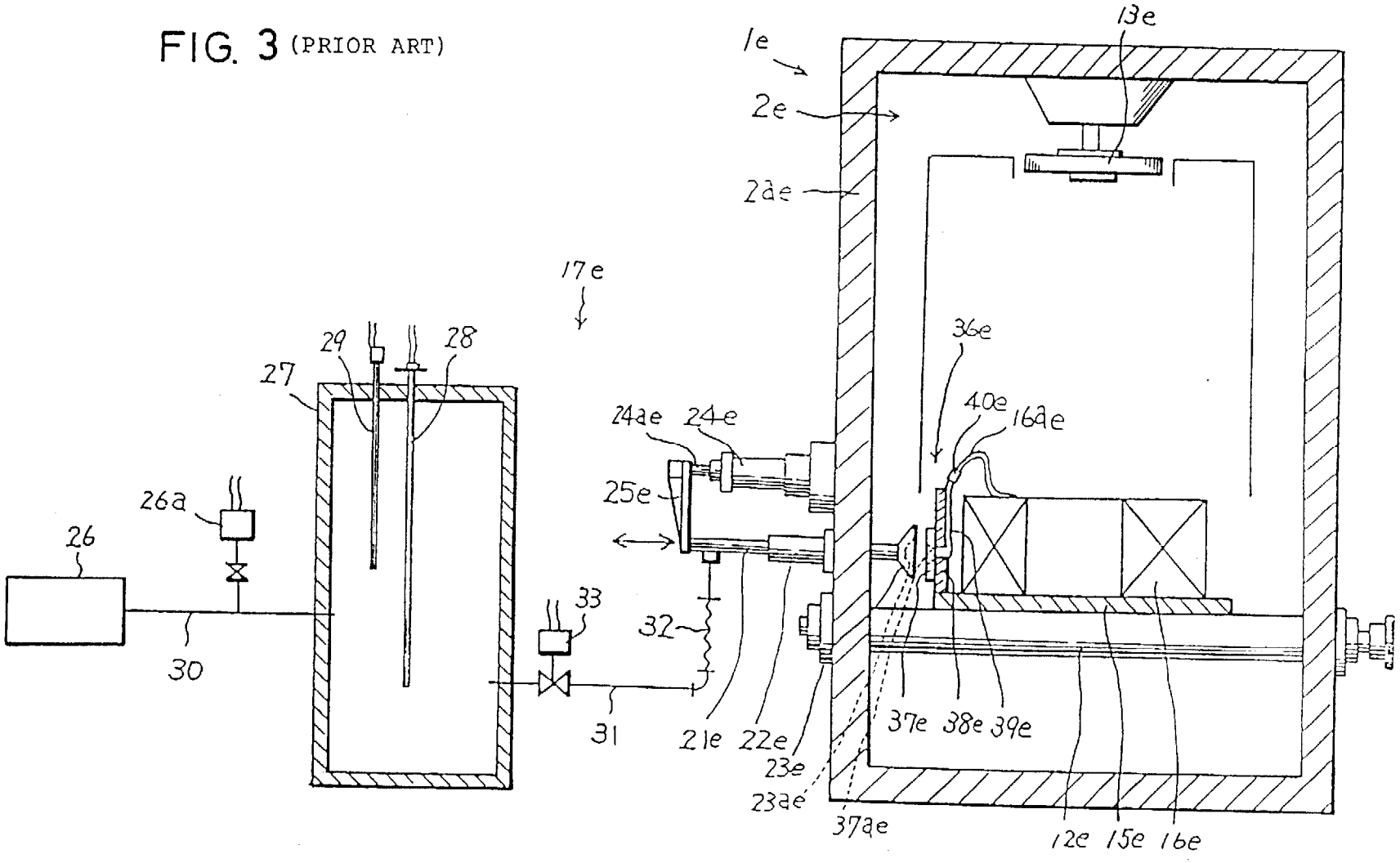
FIG. 3 (PRIOR ART)
FIG. 3 is a drawing of an embodiment having a different type of the furnace.

Referring now to FIG. 3, there is shown a different embodiment of the gas supply means and the gas supply passage for supplying the oil purging gas into the pipe coil 16*e*. Numeral 26 in FIG. 3 designates a compressor for pressurizing the oil purging gas, which gas is supplied from the gas source, for instance, a gas generating apparatus, not shown. Numeral 26*a* designates a pressure switch for automatically controlling the operation of the compressor 26 so that the gas pressure inside the surge tank 27 is set constant. The surge tank 27 serves to store the pressurized gas and has a heat insulating structure for keeping warmth of the gas stored therein to purge the oil. Numeral 28 designates heating means for heating the gas to purge the oil, which is illustrated, for instance, as a sheathed heater inserted in the surge tank 27. Numeral 29 designates detecting means for detecting the temperature of the gas within the surge tank 27 and, for instance, a thermocouple is employed for this purpose. With this detecting means the operation of the sheathed heater 28 is automatically controlled via a control device, not shown, so that the temperature of the gas in the surge tank 27 is maintained constant. Numerals 30, 31 designate connecting pipe lines and numeral 32 a flexible pipe line respectively. The flexible pipe line 32 communicates with the opening portion 23*ae* of the supply port member 23*e* through the hollow portion of the push-pull rod 21*e*. Numeral 33 designates a solenoid valve for controlling the supply of the gas to the supply port member 23*e*. In this embodiment, the gas supply passage for introducing the gas from the supply means into the furnace comprises the pipe lines 31, 32 and the hollow push-pull rod 21*e*.

The removing work of the oil from the pipe coil 16*e* in the furnace 2*e* is performed with the above-constructed gas supply means 17*e* as follows. The surge tank 27 is previously stored with the gas for discharging the oil which gas is supplied from a gas supply source, not shown, and pressurized by the compressor 26. For this purpose a gas that is free from the bad effect to the heated pipe is employed which is, for instance, air for the aluminum pipe or a non-oxidizing gas such as nitrogen for the copper one or others. The temperature of the gas in the tank 27 is maintained, by heating with the sheathed heater 28, at the high level enough to hold the vaporizing condition of the oil adhered inside the pipe, for instance, 450° C. that is higher than the vaporizing temperature. A temperature that is more than 300° C. is sufficient because the highest vaporizing temperature is 300° C. Incidentally, when the temperature of the gas from the gas supply source is as high as stated above, no heating by the sheathed heater 28 is required.

In the heating process of the pipe coil in the furnace 2*e*, when the pipe coil is in the condition heated to the predetermined high temperature, the oil in the pipe is entirely vaporized to the state of gas. When the above heating process draws to its close, the solenoid valve 33 is opened so that the high temperature gas in the surge tank 27 for purging the oil is supplied from the gas supply port member 23*e* through the intake port member 37*e* into the one end 16*ae* of the pipe of the pipe coil 16*e*. With the supply of the high temperature gas, the oil vaporized to the state of gas in the pipe is urged by the supplied gas to be discharged from the other end of the pipe. Besides, since the above-stated gas is at high temperature, the oil is discharged while its vaporized condition remains. The supply of the high temperature gas as described above in the pipe coil 16*e* is continued for sufficient time so that the oil in the gaseous state in the pipe is entirely discharged from the pipe. Although such time is varied subject to the length of the pipes of the pipe coil 16*e*, it is, for instance, a few seconds to a number of seconds, such as ten seconds. When the discharge of the oil is completed as described above, the solenoid valve 33 is closed again and the supply of the gas for discharging the oil is stopped. After that, the feeding port member 23*e* is retracted, and the pipe coil 16*e* in the furnace 2*e* is carried out to the following process.

As described above, the removing of the oil adhered inside the pipe of the pipe coil 16*e* is performed after the pipe coil 16 is heated to a raised temperature and the oil inside the pipe is vaporized in the above-stated heating process. Besides, the removal of the oil is carried out by supplying into the pipe the high temperature gas for discharging the oil. Consequently the oil in the pipe can be discharged while it is in the state of vapor.

This is effective in completing the discharging of the oil in a very short time. Accordingly, even if the oil removing work is performed in the heating process of the pipe coil, it does not exert any undesirable influence upon the heating cycle. This results in the possibility of performing the most efficient removing work of the oil by utilizing only a part of the heating process of the pipe coil.

Besides, this removing work may be performed after the passage of the predetermined heating time of the pipe coil in the furnace 2e. Moreover the discharge of the oil by feeding such high temperature gas may be performed on the way of the heating process of the pipe coil because it may be carried out if the oil in the pipe is entirely vaporized.

The temperature of the gas to be fed from the gas supply means 17e or the supply means 47 in FIG. 4 into the pipe 16ae or 16af may be lower than the above-stated oil vaporizing temperature in the following case. The temperature may be a normal temperature. That is, if the temperature of the pipe and that of the oil in the vaporized condition within the pipe are sufficiently high, the head portion of the gas, which is fed even at a lower temperature than the vaporizing one, and which contacts or is mixed with the vaporized oil, has been raised to the higher temperature than the above-stated vaporizing temperature in a very short time. As a result, the oil remains in the vaporized condition in the pipe. Accordingly, even if the above-stated gas is at a low temperature, it is possible to carry out the removal of the vaporized oil from the pipe.

Incidentally, in the above-stated gas supply means, the parts which seem duplicated in the explanation because of the same or equivalent functional construction as those in the former figure are designated with the same references attached with letter 'e' to avoid the duplication. Also in the following FIG. 4 to FIG. 6, according to the same intention, the duplicated explanation is avoided by employing the same references attached with letter 'f'.

Figure 4:
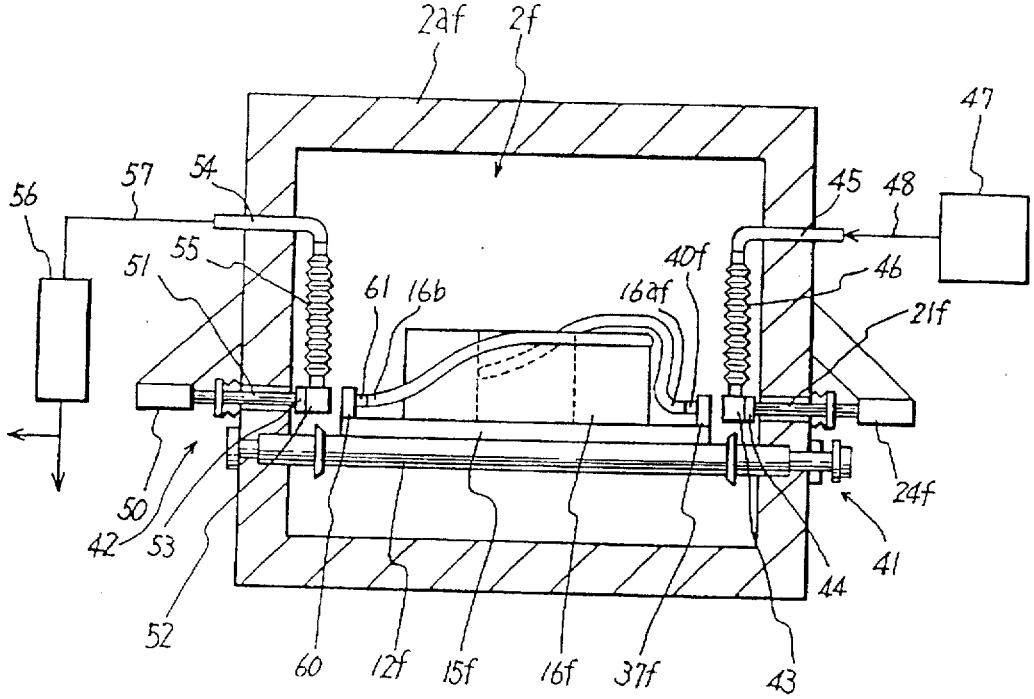
FIG. 4 is a drawing of an embodiment having a further different type of the furnace.

Referring now to FIG. 4, there is shown another embodiment of the furnace 2f in the heat treatment apparatus 1f. The furnace 2f shown in this embodiment is provided with a supply mechanism 41 for feeding the purge gas from the outside of the furnace into the pipe coil within the furnace and provided with an exhaust mechanism 42 for exhausting the purging gas discharged from the pipe coil 16f out of the furnace.

The supply mechanism 41 will be first described. Numeral 43 designates a supply port member shown as an example of communicating means, which is connected to a push-pull rod 21f through universal joint means 44 shown as an example of a flexible joint. The push-pull rod 21f employs the piston rod of a cylinder 24f whose body is mounted on the furnace 2f. Numeral 45 designates a penetrating pipe making a way into the furnace 2f for feeding the gas into the furnace. Numeral 46 designates a flexible pipe for communicating the supply port member 43 with the penetrating pipe 45, which flexible pipe also has a function to support the weight of the supply port member 43. Numeral 47 designates a source of the purging gas as gas supply means and numeral 48 a pipe line for connecting the supply source 47 to the penetrating pipe 45. Incidentally, in this embodiment, the gas supply passage for feeding the gas from the feed means into the furnace comprises the members designated with the reference numerals 45, 46, 48.

Next, the exhaust mechanism 42 has a construction equivalent to the above-stated supply mechanism 41. Numeral 50 designates a cylinder employed as a push-pull device, and numeral 51 a push-pull rod comprising the piston rod of the device 50. Numeral 52 designates an exhaust port member shown as an example of communicating means for communicating the pipe coil at the other end, which member is connected through universal joint means 53 to the above-stated push-pull rod 51. The exhaust passage for introducing the vaporized oil to the outside of the furnace comprises members designated with numerals 54, 55. Numeral 54 designates a penetrating pipe for exhausting the gas to the outside of the furnace, and numeral 55 a flexible pipe. Numeral 56 is a heat exchanger and numeral 57 a pipe line respectively.

Next, numeral 60 designates a discharge port member mounted on the tray 15f, which is provided with a coupling 61 for connecting the pipe. The coupling 61 is adapted to connect the other end 16b of the pipe coil 16f.

Figure 5:
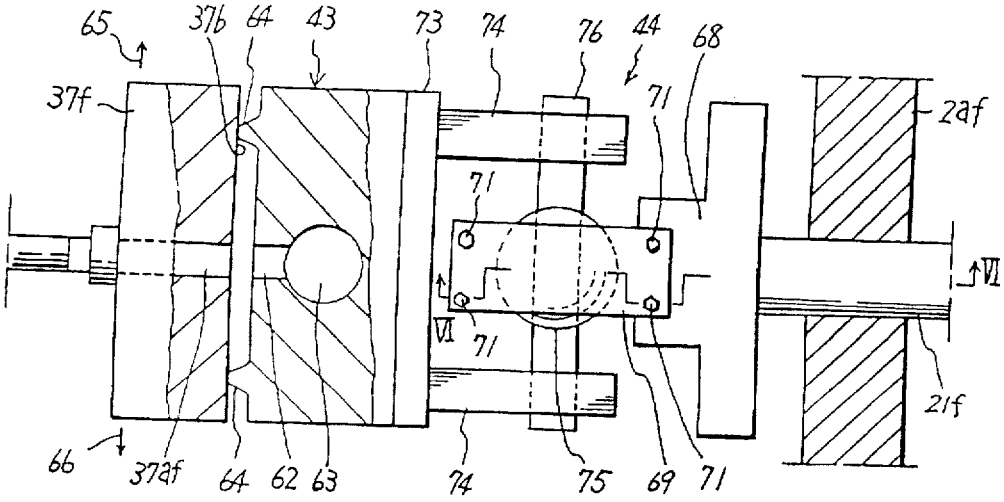
FIG. 5 is a plan view, partly in cross section, showing a supply port member and a universal joint means.
Figure 6:
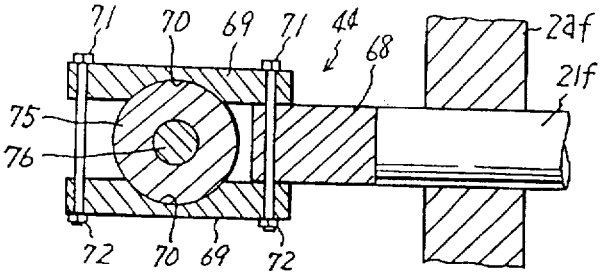
FIG. 6 is a sectional view taken on line VI—VI of FIG. 5.

Referring now to FIG. 5 and FIG. 6, there is shown the supply port member 43. Numeral 62 designates an opening for feeding the gas and numeral 63 is a through hole which is communicated with the opening 62 at the one end and connected to the flexible pipe 46 at the other end. Numeral 64 designates an extruded abutting member opposed to the intake port member 37f which is formed to surround the opening portion 62. The front view of this abutting member 64 is a lateral ellipse which can surround the opening portion 37af even if the intake port member 37f is shifted laterally against the supply port member 43 in the arrow directions 65, 66. The tip of the abutting member 64 is round in cross section so that the metallic touch against the flat front surface 37b of the intake port member 37f is possible and so that the front surface 37b of the intake port member 37f is prevented from damage.

Next, the universal joint means 44 shown in FIG. 5 and FIG. 6 will be described. Numeral 68 is a base member, which is fixed to the push-pull rod 21f. Numerals 69, 69 designate a pair of support members with support surfaces 70 in the form of spherical recesses, which are fastened to the base member 68 with bolts 71 and nuts 72 shown as an example of fastener means. Numeral 73 is a joint plate which mounts the supply port member 43. Numerals 74, 74 designate a pair of support rods which are fixed to the joint plate 73 at their roots. To the end portions of the support rods 74, 74 there is fixed a shaft 76 which is mounted to a spherical body 75 so that it is inserted through the center of the body. The spherical body 75 is held between the pair of support members 69, 69 so that the supply port member 43 can swing its head up and down or left and right. Incidentally, as the exhaust port member 52 and universal joint means 53 have constructions equivalent to the above-stated supply port member 43 and universal joint means 44 respectively, the duplicated description is omitted.

The purging work of the gas inside the pipe coil 16f in the heating chamber 2f constructed above will be described. The pipe coil 16f in the state mounted on the tray 15f is carried into the furnace 2f and stopped at the predetermined position. Then, in the supply mechanism 41 and exhaust mechanism 42, the push-pull rods 21f, 51 are advanced to the tray 15f so that the supply port member 43 is connected to the intake port member 37f, and the exhaust port member 52 is connected to the discharge port member 60. If the tray 15f is, for instance, in a slightly rotated state within the horizontal surface during the above-stated connection, the front surface 37b of the intake port member 37f is not opposed to the supply port member 43 but in a slanting state. But, since the supply port member 43 is connected to the push-pull rod 21f via the universal joint means 44, when a part of the abutting member 64 in the supply port member 43 is abutted to the front surface 37b of the intake port member 37f as the push-pull rod is advanced, the supply port member 43 changes its direction according to the direction of the front surface 37b of the intake port member 37f. As a result, the abutting member 64 is abutted at the entire circumference to the front surface 37b of the intake port member 37f in a state of metallic touching. Incidentally, the connection of the exhaust port member 52 and discharge port member 60 is performed in the same manner as described above.

In the state that the above connection has been accomplished, the purging gas supplied from the gas supply source 47 runs through the pipe line 48, penetrating pipe 45, flexible pipe 46, supply port member 43 and through the intake port member 37*f* and is fed into the one end 16*af* of the pipe of the pipe coil 16*f*. The gas discharged from the other end 16*b* of the pipe of the pipe coil 16*f* according to the above-stated feeding, runs from the discharge port member 60 through the exhaust port member 52, flexible pipe 55, penetrating pipe 54, and pipe line 57, and reaches the heat exchanger 56.

Figure 7:
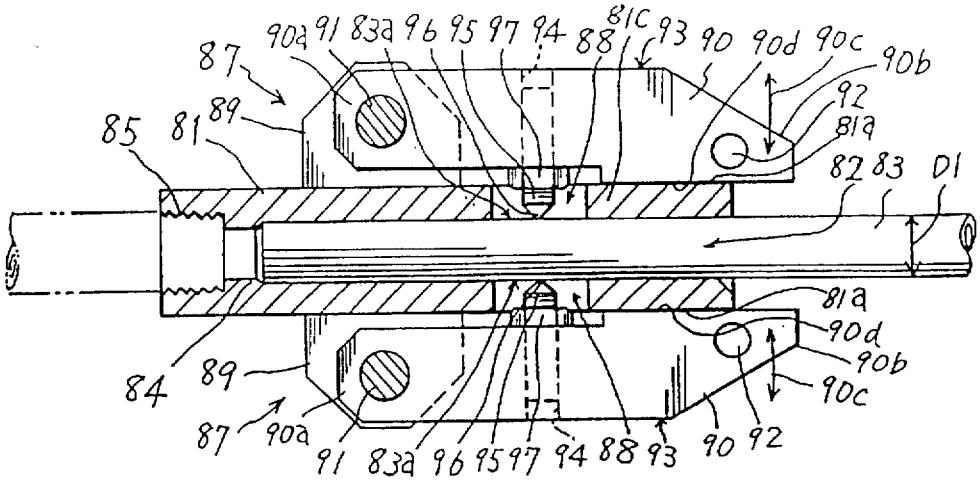
FIG. 7 is a vertical sectional view of a pipe connecting device in the state that an objective pipe is connected.
Figure 8:
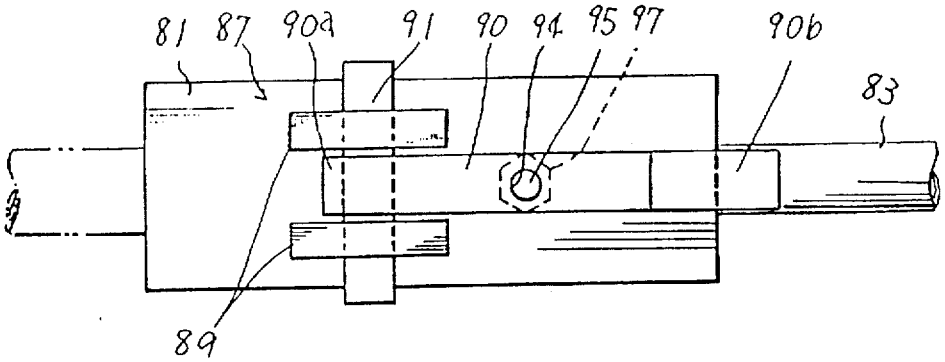
FIG. 8 is a plan view of a pipe connecting device in the state that an objective pipe is connected.
Figure 9:
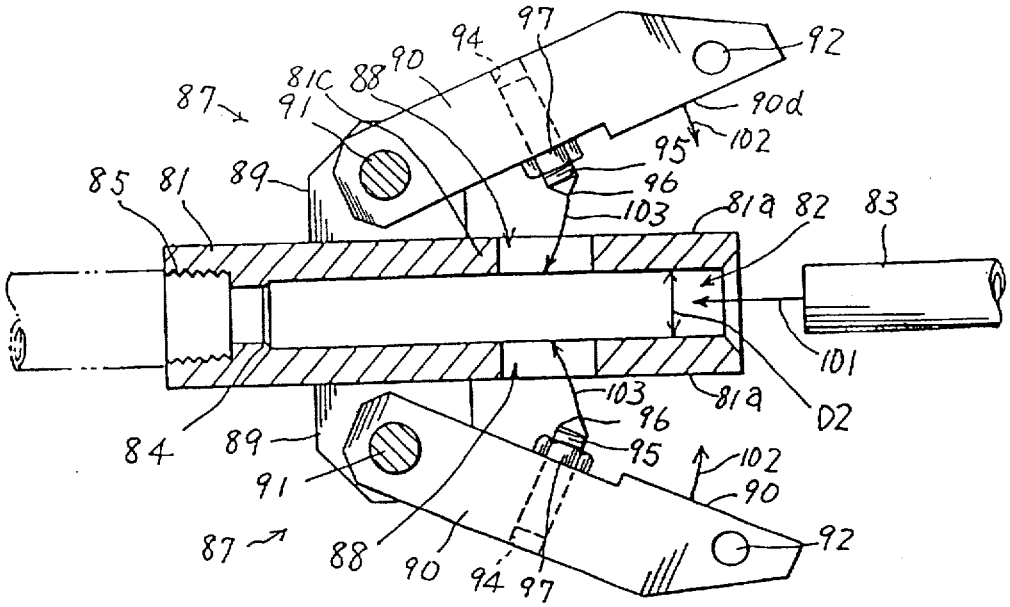
FIG. 9 is a vertical sectional view of a pipe connecting device in the state that an objective pipe is not connected.

Referring now to FIG. 7 to FIG. 9 there is shown a pipe connecting device which is employable as the above-stated couplings 40, 40*f*, 61 for the connection between the pipe joint 39 and pipe 16*a*, between the intake port member 37*f* and pipe 16*af*, and between the discharge port member 60 and pipe 16*b*. Hereinafter those drawings will be described. Numeral 81 designates a body, which is formed employing heat resistant material, for instance, steel such as SS400, SUS304, which has sufficient gas resistance and mechanical strength, even if it is heated at the specified heat treatment temperature in the atmospheric gas for heat treatment, for instance, annealing for the pipe as an object to be connected. Numeral 82 is an insert hole for inserting the objective pipe 83, which is equivalent to, for instance, the one pipe end 16*a* and the other pipe end 16*b* of the pipe coil 16. The insert hole 82 has the inner diameter D2 corresponding to the outer diameter D1 of the objective pipe 83 to be connected. The objective pipe 83 is, for example, a copper pipe with the outer diameter D1 of 4 to 16 mm generally and with the thickness of 0.3 to 0.4 mm generally. The outer diameter of the above-stated embodiment is, for example, 9.5 mm and the thickness 0.3 mm. When the diameter is 9.5 mm, the inner diameter D2 of the insert hole is 9.7 mm. Numeral 84 is a stopper for positioning the objective pipe 83 to the predetermined depth when it is inserted into the insert hole 82. Numeral 85 is a communicating hole provided in communication with the insert hole 82 for communicating with the objective pipe 83 inserted in the insert hole 82, which hole is shown, for instance, as a threaded hole for connecting another pipe such as the pipe joint 39 shown in FIG. 2. But this communicating hole 85 may be a through hole directly communicating with the gas supply port of the gas supply apparatus. Furthermore, the body 81 may be formed as a monolithic construction with the intake port member 37*f* or discharge port member 60 in FIG. 4 and the communicating hole 85 may be communicated with those openings.

Next, numeral 87 designates a clamping mechanism for tightly holding the objective pipe which is inserted into the above-stated insert hole 82. This clamping mechanism 87 may be provided in the numbers enough to obtain the necessary clamping strength, and two units are installed in this embodiment. But one unit or more than three units may be allowable. Hereinafter, the clamping mechanism 87 will be described. Numeral 88 is a through hole provided in the peripheral wall 81*c* of the body 81 through which hole a fixing member 95 may be caused, from the outside of the body 81, to reach the periphery of the objective pipe 83 inserted into the insert hole 82. When the fixing member 95 is stuck into the objective pipe 83, the inner circumferential surface of said insert hole 82 holds the periphery of the objective pipe 83 except the stuck portion to prevent the objective pipe 83 from being deformed. Accordingly the through hole 88 may be formed as small as possible to cause the fixing member 95 to reach the pipe 83. Numeral 89 is a fitting member provided on the periphery of the body 81 to fit the retainer member for rotation, which is formed in a unit with the body 81 by welding means. The member 89 may be formed in a monolithic construction with the body 81.

Next, numeral 90 is a retainer for retaining the fixing member 95. This retainer 90 is fitted for rotation at one end 90*a* to the above-stated fitting member 89 through a shaft 91 so that the other end 90*b* can approach or leave the body 81 as shown by an arrow 90*c* in FIG. 7. Numeral 90*d* is a portion for determining the access position of the retainer 90 to the body 81, which is shown, for instance, as an abutting portion to contact to the stopper portion 81*a*. Numeral 92 is a through hole for inserting the wire member to tie the retainer 90. The through hole 92 is provided on the location of the other end 90*b* sufficiently distant from the above-stated one end 90*a* so that the tying effect is exerted as large as possible. Numeral 94 is a retaining hole for retaining the fixing member 95. This retaining hole 94 is provided in the state that the axis line of the retaining hole 94 is crossing at a right angle to the axis line of the above-stated insert hole 82 when the abutting portion 90*d* is contacted to the stopper portion 81*a*. This retaining hole 94 is formed as a threaded hole to fit the fixing member 95.

Next, a threaded bar is employed, for instance, as the fixing member 95, which is screwed into the retaining hole 94 so that it is possible to adjust the position of the fixing member 95 in the axial direction. The tip of the fixing member 95 is sharpened to stick into the periphery of the objective pipe 83 and called as a tip 96 in the present specification. The shape of the tip 96 is designed so that it is easy to stick into the periphery 83*a* of the objective pipe 83 to be connected, and so that the strength may be obtained which is necessary and sufficient to restrain objective pipe 83 from slipping out of the insert hole 82 when the tip 96 is in the stuck condition. Such a shape of the tip 96 may be determined according to the material, outer diameter, thickness or the like of the pipe 83 to be connected. For instance, it is allowable to form the tip 96 as a conical shape with the vertical angle of about 90 degree. Numeral 97 is a nut screwed with the fixing member 95 to fasten the fixing member 95 to the retainer 90. Each member of the clamping mechanism 87 as constructed above is formed for the similar purpose and from the similar materials to the above-stated body 81.

The connection of the objective pipe 83 to the pipe connecting device as constructed above is carried out as follows. From the state shown in FIG. 9, the objective pipe 83 is inserted in the direction of the arrow 101, and abutted at the top end to the stopper 84. Next, the retainer 90 is caused to approach the body 81 in the arrow direction 102 to abut the abutting portion 90*d* to the stopper portion 81*a* as shown in FIG. 7. As a result, the tip 96 of the fixing member 95 is stuck into the periphery 83*a* of the objective pipe 83 to the predetermined depth as shown in the arrow 103.

In the above-described sticking, there is an advantage as follows. That is, the fixing member 95 is installed in the retaining hole 94 provided on the location, in the parallel direction to the axial line of the insert hole 82, distant from the shaft 91 in the retainer 90. Consequently, when the fixing member 95 moves to the periphery 83*a* of the objective pipe 83, the component of the movement in the axial direction of the objective pipe 83 is small. Therefore, the tip 96 moves in the direction substantially vertical to the periphery 83*a* and the above sticking is performed. As a result, when the tip 96 sticks into the periphery 83*a* of the objective pipe 83, the periphery 83*a* is not marked with any damage in the direction parallel to the axial line of the objective pipe 83. Furthermore, since the fixing member 95 is installed in the retaining hole 94 as constructed above, the axial line of the fixing member 95 is crossing at a right angle to the axial line of the insert hole 82, in the state that the abutting portion 90*d* abuts the stopper portion 81*a*. Accordingly, the fixing member 95 sticks at its tip 96 substantially vertical to the periphery of the objective pipe 83.

After the sticking of the tip 96 against the objective pipe 83 is carried out as described above, the wire means, for example, a wire near at hand is inserted into the through hole 92 and ties the retainer 90 to the body 81 so that the retainer 90 may not leave the body 81. In the case of the present embodiment, owing to two units of the clamping mechanisms, it is possible to tie together both retainers 90 to the body 81 by tying in the state that the wire is layed away between both the through holes 92. As described above, the connecting work of the pipe 83 to be connected is completed.

In addition, the above-stated wire means may be employed in the following manner except for the method of tying by inserting into the through hole 92. That is, the retainer 90 is previously provided with a catching surface 93. This catching surface 93 is provided on the opposite surface of the retainer 90 with the body 81 in the state that the retainer 90 is close to the body 81. When the retainer 90 is tied with the body 81, the above-stated catching surface 93 and body 81 are wound up by the wire means. Incidentally, when there are more than two units of the clamping mechanisms, the catching surface 93 of each clamping mechanism 87 is wound up by the wire means.

The pipe connecting device connected with the objective pipe 83 as described above is exposed to the high temperature inside the furnace during the heat treatment of the objective pipe 83, for instance, annealing in the annealing furnace. And at the same time, the purge gas is fed into the objective pipe 83 through the communicating port 85. In this case, according to the pressure of the above-stated purging gas (for instance, 3.5 to 9.5 kg/cm$^2$), the force is applied in the direction of drawing out the objective pipe 83 from the insert hole 82 of the body 81. But the tip 96 of the fixing member 95 is stuck into the periphery 83*a* of the pipe 83 substantially in the vertical direction to the surface 83*a* so that an accident such as the pipe 83 being drawn out of the insert hole 82 is prevented even if the objective pipe 83 is softened.

As described above, the pipe connecting device is effective in connecting the objective pipe 83 in exceedingly easy and rapid manner according to three operations first that the objective pipe 83 is inserted into the insert hole 82 when the objective pipe 83 is connected to the body 81, secondly that the tip 96 of the fixing member 95 is stuck into the periphery 83*a* of the objective pipe 83 by putting the retainer 90 close to the body 81, and thirdly that the retainer 90 is tied by the wire means so as not to leave the body 81.

In addition to the above-described connected state, it is an advantage that the tip 96 of the fixing member 95 is stuck into the periphery 83*a* of the objective pipe 83 substantially in the vertical direction to the periphery 83*a*. This is very effective in preventing the objective pipe 83 from falling out of the insert hole 82 even if the objective pipe 83 is softened by heating and effective in securely maintaining the fixed state of the objective pipe to the connecting device.

What is claimed is:

1. A method of removing oil from the oil-containing pipe of a pipe coil which comprises the steps of:

(a) providing a pipe of a pipe coil having oil adhered to the inner surface of said pipe;

(b) heating said pipe coil within a furnace to a temperature above the vaporizing temperature of said oil adhered to the inner surface of said pipe of said pipe coil to vaporize said oil within said pipe, (c) feeding an oil purging gas into one end of said pipe of said pipe coil after said oil has been vaporized, and (d) discharging said vaporized oil with said purging gas from the other end of said pipe, (e) said purging gas having a sufficiently high temperature to maintain the vaporized condition of said oil;

(f) wherein said step of discharging the vaporized oil from the other end of said pipe includes the step of discharging the vaporized oil from the furnace.

2. A method of removing oil from the interior of an oil-containing pipe which comprises the steps of:

(a) providing a pipe of a pipe coil having oil adhered to the interior surface of said pipe;

(b) heating said pipe coil within a furnace to a temperature above the vaporizing temperature of the oil adhered to the interior surface of the pipe of said pipe coil, and (c) feeding an oil purging gas into one end of the pipe of said pipe coil after said oil is vaporized, (d) heating said gas to a sufficiently high temperature to maintain the vaporized condition of the oil in the pipe, and (e) discharging the vaporized oil inside the pipe outwardly from the other end of the pipe;

(f) wherein said step of discharging the vaporized oil from the other end of said pipe includes the step of discharging the vaporized oil from the furnace.

* * * * *